US009850699B2

(12) United States Patent
Garrett

(10) Patent No.: US 9,850,699 B2
(45) Date of Patent: Dec. 26, 2017

(54) BUCK PANEL FOR FORMING A BUCK ASSEMBLY

(71) Applicant: BuildBlock Building Systems, LLC, Oklahoma City, OK (US)

(72) Inventor: David Michael Garrett, Oklahoma City, OK (US)

(73) Assignee: BuildBlock Building Systems, LLC, Oklahoma City, OK (US)

( * ) Notice: Subject to any disclaimer, the term of this patent is extended or adjusted under 35 U.S.C. 154(b) by 0 days.

(21) Appl. No.: 15/250,377

(22) Filed: Aug. 29, 2016

(65) Prior Publication Data

US 2017/0058591 A1 Mar. 2, 2017

Related U.S. Application Data

(60) Provisional application No. 62/211,072, filed on Aug. 28, 2015.

(51) Int. Cl.

| | |
|---|---|
| ***E04B 1/00*** | (2006.01) |
| ***E06B 1/02*** | (2006.01) |
| ***E04B 2/86*** | (2006.01) |
| ***E06B 1/32*** | (2006.01) |

(52) U.S. Cl.

CPC ..... *E06B 1/02* (2013.01); *E04B 2/86* (2013.01); *E06B 1/32* (2013.01); *E04B 2002/8676* (2013.01)

(58) Field of Classification Search

CPC ... E06B 1/342; E06B 1/36; E06B 1/24; E06B 1/52; E06B 2002/8676; E04B 2/86

USPC ..... 52/105, 215, 309.11, 309.12

See application file for complete search history.

(56) References Cited

U.S. PATENT DOCUMENTS

| | | | | |
|---|---|---|---|---|
| 2,787,820 A * | 4/1957 | Shields | E04G 15/02 | 249/177 |
| 3,331,174 A * | 7/1967 | Wesch | B62D 33/04 | 52/309.11 |
| 4,031,285 A * | 6/1977 | Miller | B28B 1/50 | 428/119 |
| 4,157,640 A * | 6/1979 | Joannes | B29C 44/1276 | 52/309.12 |
| 4,641,469 A * | 2/1987 | Wood | E04C 2/384 | 52/309.12 |
| 4,730,422 A * | 3/1988 | Young | E04B 1/86 | 52/105 |

(Continued)

OTHER PUBLICATIONS

International Search Report and Written Opinion (PCT/US2016/049284); dated Jan. 17, 2017.

*Primary Examiner* — Basil Katcheves
(74) *Attorney, Agent, or Firm* — Dunlap Codding, P.C.

(57) ABSTRACT

A buck panel adapted to be interconnected with other panels to form a buck to frame a bulkhead or an opening in an insulated concrete form wall for receiving a window or door. The buck panel has a foam portion, a central support beam, a first lateral support beam, and a second lateral support beam. The central support beam is positioned longitudinally within a center portion of the foam portion. A plurality of wings extend from the central support beam in such a way that the wings protrude from an internal surface of the foam portion so as to be received in concrete poured over the internal surface. The first and second lateral support beams are positioned longitudinally within a first side and a second side of the foam portion, respectively.

17 Claims, 6 Drawing Sheets

(56) References Cited

U.S. PATENT DOCUMENTS 5,040,344 A * 8/1991 Durand ..... E04B 2/8635 52/127.2
5,319,884 A * 6/1994 Bergeron ..... E06B 5/08 49/466
5,896,714 A * 4/1999 Cymbala ..... E04B 2/8617 52/426
5,996,293 A 12/1999 Anderson et al.
6,070,375 A 6/2000 Anderson et al.
6,298,622 B1 * 10/2001 Cretti ..... B29C 45/14311 52/309.12
6,453,620 B1 * 9/2002 Williams ..... E04G 15/02 249/142
6,481,178 B2 * 11/2002 Moore, Jr. ..... B28B 19/003 52/309.11
6,530,185 B1 3/2003 Scott et al.
7,032,357 B2 * 4/2006 Cooper ..... E04B 2/8617 52/309.11
7,490,442 B1 2/2009 Jackson et al.
8,037,652 B2 * 10/2011 Marshall ..... E02D 27/02 52/309.11
RE43,251 E 3/2012 Anderson et al.
RE43,457 E 6/2012 Anderson et al.
8,495,843 B1 7/2013 Horneland
8,561,371 B2 * 10/2013 Sanders ..... E01F 8/0023 52/745.09
8,931,220 B2 1/2015 Stewart et al.
9,016,011 B2 * 4/2015 Stewart ..... E06B 1/32 52/204.1
9,109,360 B2 * 8/2015 Stewart ..... E06B 1/02
2003/0005659 A1 1/2003 Moore, Jr.
2006/0117690 A1 * 6/2006 Garrett ..... E04B 2/8617 52/309.11
2009/0193729 A1 8/2009 Kustermann
2010/0071306 A1 * 3/2010 Williams ..... E04B 2/8617 52/712
2010/0269433 A1 * 10/2010 Westra ..... E04G 15/02 52/215
2010/0325984 A1 * 12/2010 Richardson ..... E06B 1/02 52/215
2011/0047920 A1 * 3/2011 Garrett ..... E04B 5/19 52/565
2011/0214370 A1 9/2011 Stewart
2012/0096797 A1 * 4/2012 Garrett ..... E04B 2/8635 52/426
2012/0216478 A1 * 8/2012 Mees ..... E04B 2/8617 52/426
2014/0130431 A1 * 5/2014 Stewart ..... E06B 1/02 52/215
2014/0130432 A1 5/2014 Stewart

* cited by examiner

BUCK PANEL FOR FORMING A BUCK ASSEMBLY

CROSS-REFERENCE TO RELATED APPLICATION

This application claims priority to U.S. Provisional Application Ser. No. 62/211,072, filed on Aug. 28, 2015, the entire contents of which being hereby expressly incorporated herein by reference.

BACKGROUND

Construction utilizing insulating concrete forms (ICFs) (also known as insulated concrete forms) is well known in the art. Insulating block systems or interlocking modular units are dry-stacked, horizontal and vertical reinforcing rods (rebar) are installed as the forms are being placed, and then the forms are filled with concrete. Window and door openings in the concrete walls are framed prior to pouring the concrete. Window or door bucks are frames that provide the rough structure and opening into which the window or door will be installed. Bucks are also used to form bulkheads. Bucks have typically been constructed of materials such as wood, plastic, and steel. However, in concrete walls formed using insulated block systems, such bucks can be difficult to install and use because the bucks lack continuity of material with the insulating concrete forms. Insulating concrete form bucks have been developed; however, there remains room for improvement in terms of ease of installation and use.

To this end, a need exists for a buck panel that can be interconnected with other buck panels to form a buck assembly that is uniform in construction and that is readily and reliably installed in an insulating concrete form wall to frame an opening for a door or window or a bulkhead. It is to such a buck panel that the inventive concepts disclosed and claimed herein are directed.

BRIEF DESCRIPTION OF THE DRAWINGS

Like reference numerals in the figures represent and refer to the same or similar element or function. Implementations of the disclosure may be better understood when consideration is given to the following detailed description thereof. Such description makes reference to the annexed pictorial illustrations and drawings. The figures are not necessarily to scale and certain features and certain views of the figures may be shown exaggerated, to scale or in schematic in the interest of clarity and conciseness. In the drawings.

DETAILED DESCRIPTION OF EXEMPLARY EMBODIMENTS

Figure 1A:
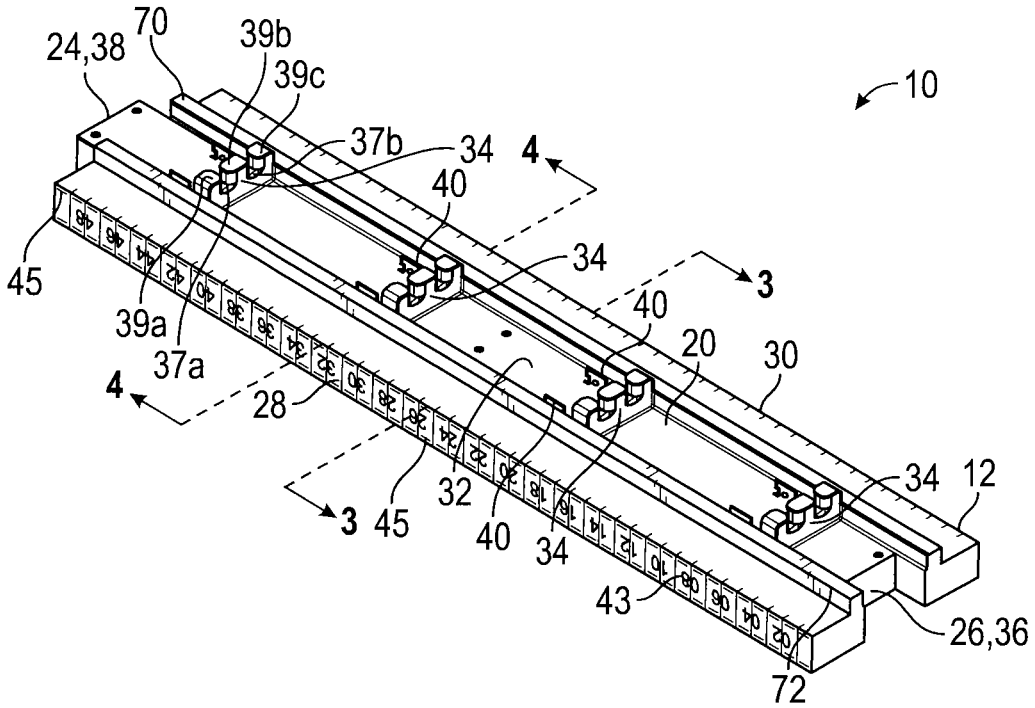
FIG. 1A is a perspective view of a buck panel constructed in accordance with the inventive concepts disclosed herein.

Before explaining at least one embodiment of the inventive concept disclosed herein in detail, it is to be understood that the inventive concept is not limited in its application to the details of construction, and/or the arrangement of the components set forth in the following description, or illustrated in the drawings. The presently disclosed and claimed inventive concept is capable of other embodiments or of being practiced or carried out in various ways. Also, it is to be understood that the phraseology and terminology employed herein is for purpose of description only and should not be regarded as limiting in any way.

In the following detailed description of embodiments of the inventive concept, numerous specific details are set forth in order to provide a more thorough understanding of the inventive concept. However, it will be apparent to one of ordinary skill in the art that the inventive concept within the disclosure may be practiced without these specific details. In other instances, well-known features have not been described in detail to avoid unnecessarily complicating the instant disclosure.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or at least one and the singular also includes the plural unless it is obvious that it is meant otherwise.

Referring now to the drawings, and more particularly to FIGS. 1A-6, shown is a buck panel 10 constructed in accordance with the inventive concepts disclosed herein. The buck panel 10 is adapted to be interconnected with other panels to form a buck to frame an opening in a wall for receiving a window or a door or to form a bulkhead. The buck panel 10 has a foam portion 12, a central support beam 14, a first lateral support beam 16, and a second lateral support beam 18. The foam portion 12 has an internal surface 20, an exterior surface 22, a first end 24, a second end 26 opposite the first end 24, a first side 28, a second side 30 opposite the first side 28 and separated from the first side 28 by a center portion 32. A plurality of rebar holding members 34 extend outwardly from the internal surface 20 along the center portion 32. The second end 26 includes a recessed portion 36 that is matingly receivable of a protruding portion 38 of a first end of a like panel so that the buck panel 10 can be interconnected with the like panel in both a parallel and a right-angle end-to-end relationship. The central support beam 14 is positioned longitudinally and molded within the center portion 32 of the foam portion 12. The central support beam includes a plurality of wings 40 protruding from the internal surface 20 of the foam portion 12. The first lateral support beam 16 is positioned longitudinally and molded within the foam portion 12 near the first side 28 of the foam portion 12. Similarly, the second lateral support beam 18 is positioned longitudinally and molded within the foam portion 12 near the second side 30 of the foam portion 12.

The foam portion of the buck panel 10 may be formed of a fire retardant expanded polypropylene, polystyrene, polyethylene or other suitable polymers. In one embodiment, the foam portion 12 is formed of expanded polystyrene commonly referred to as "EPS."

The internal surface 20 of the foam portion 12 is designed to face a cavity of an insulating concrete block form during construction of a wall with an opening such as for a door or window. As shown in FIG. 1A, the internal surface 20 can include advertising indicia, instructions, and guides. The internal surface 20 is shaped during molding to form the plurality of rebar holding members 34. Each of the rebar holding members 34 may include one or more seats for rebar positioning. More particularly, seats 37*a* and 37*b* are defined by restraining fingers 39*a*, 39*b*, and 39*c*. The seats 37*a* and 37*b* may be dimensioned to receive one or more pieces of rebar (not shown) in a stacked orientation. In one embodiment, the restraining fingers 39*a*, 39*b*, and 39*c* are spaced from one another such that the compressibility and resiliency of the foam portion 12 allows the restraining fingers 39*a*, 39*b*, and 39*c* to frictionally grip rebar positioned in the seats 37*a* and 37*b*.

Figure 1B:
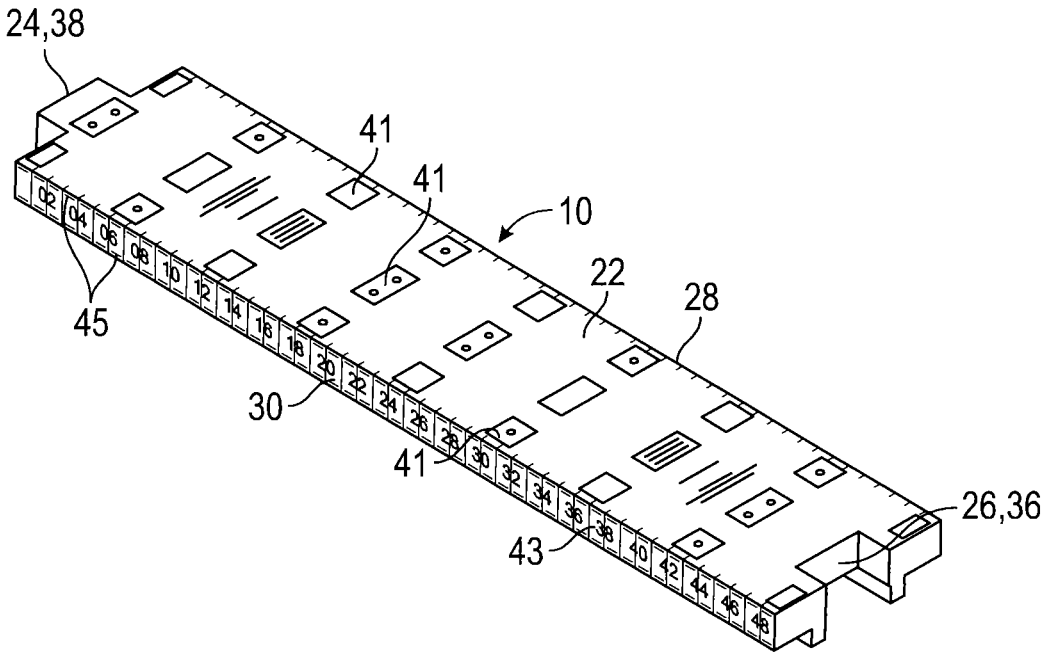
FIG. 1B is a perspective view of an exterior of the buck panel of FIG. 1A.

As shown in FIG. 1B, the exterior surface 22 is substantially planar and uniform in configuration. The exterior surface 22 is intended to face the opening for the door or window and can include advertising indicia as well as instructions and guides. Areas that can accept screws or nails can be indicated by markings 41 on the exterior surface 22 to assist a builder in finishing the window or door within the buck formed by buck panels 10.

Figure 2A:
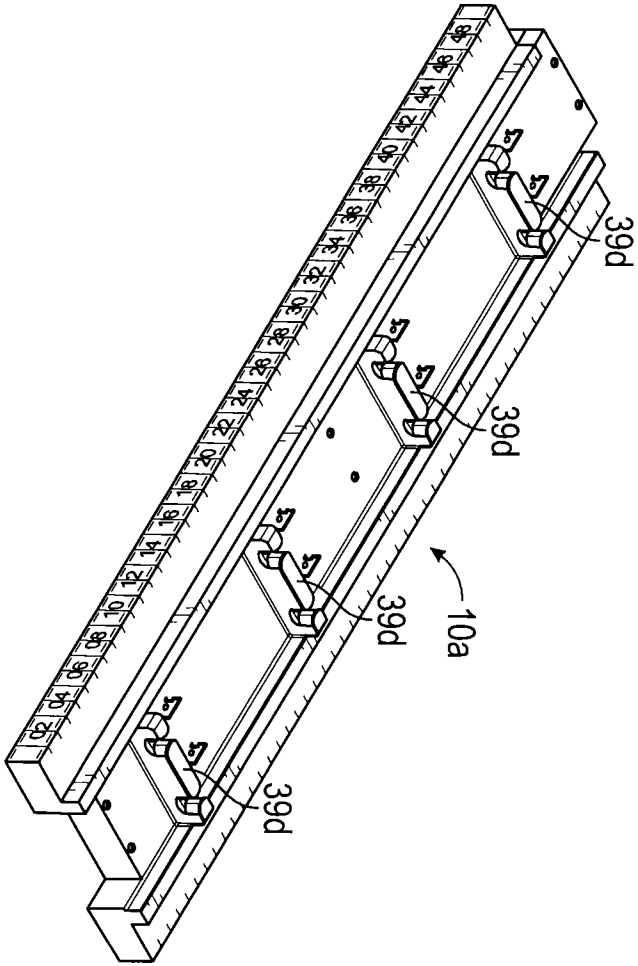
FIG. 2A is a perspective view of another embodiment of a buck panel constructed in accordance with the inventive concepts disclosed herein.

FIG. 2A illustrates another embodiment of a buck panel 10*a*. The buck panel 10*a* is similar in construction to the buck panel 10 except as described below. The buck panel 10*a* has a width that is greater than the width of the buck panel 10. To this end, the buck panel 10 has a restraining finger 39*d* having a width greater than the width of the restraining finger 39*b*.

Figure 2B:
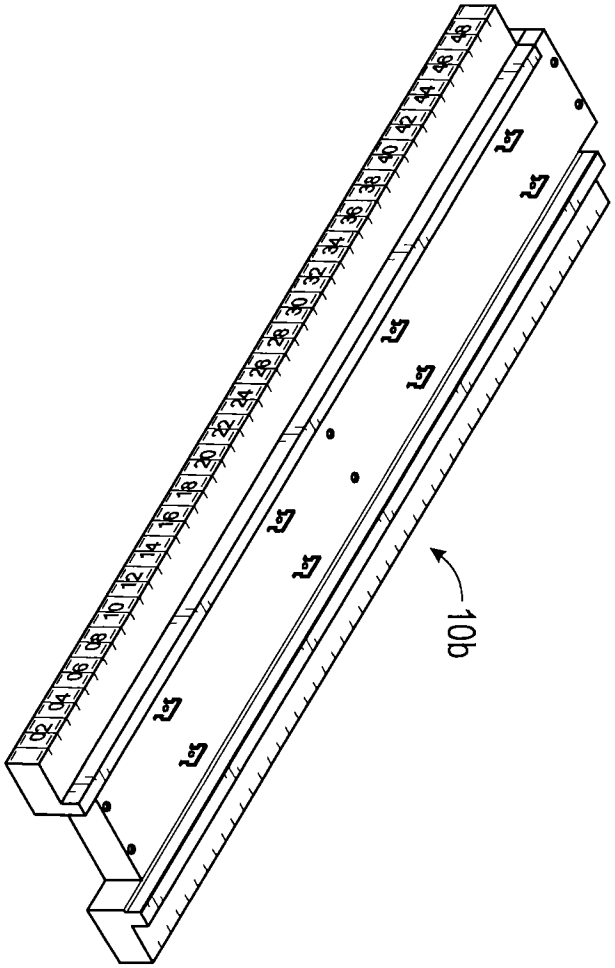
FIG. 2B is a perspective view of another embodiment of a buck panel constructed in accordance with the inventive concepts disclosed herein.

FIG. 2B illustrates another embodiment of a buck panel 10*b*. The buck panel 10*b* is similar in construction to the buck panel 10*b* except the buck panel 10*b* is formed without any restraining fingers.

As shown in FIGS. 1A and 1B, markings 43 may be provided along the first side 28 and the second side 30 of the foam portion 12 to indicate length. Such markings may serve as guidelines for assisting the installer to cut the buck panel 10 to a desired size. The markings 43 may be spaced at one inch intervals; however, it will be appreciated that other intervals may be used. In addition, some or all of the markings 43 may be identified with numerals, similar to a measuring tape. This allows an installer to cut the buck panels 10 without the need of marking the cut point on the panel, or may eliminate the need to measure the form during the installation or cutting process of installation.

The first side 28 and the second side 30 may further be marked (as indicated with dashed markings 45) to indicate the upper and lower boundaries of the first lateral support beam 16 and the second lateral support beam 18, respectively. The first lateral support beam 16 and the second lateral support beam 18 provide attachment points along the length of the first side 28 and the second side 30 of the buck panel 10 in a manner to be described below.

Figure 3:
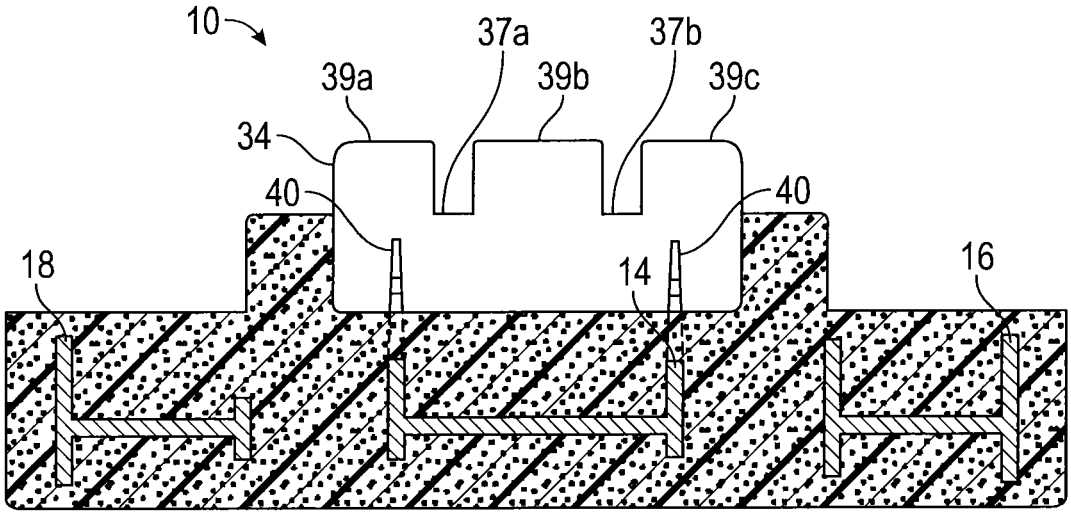
FIG. 3 is a sectional view taken along line 3-3 of the buck panel in FIG. 1.
Figure 5:
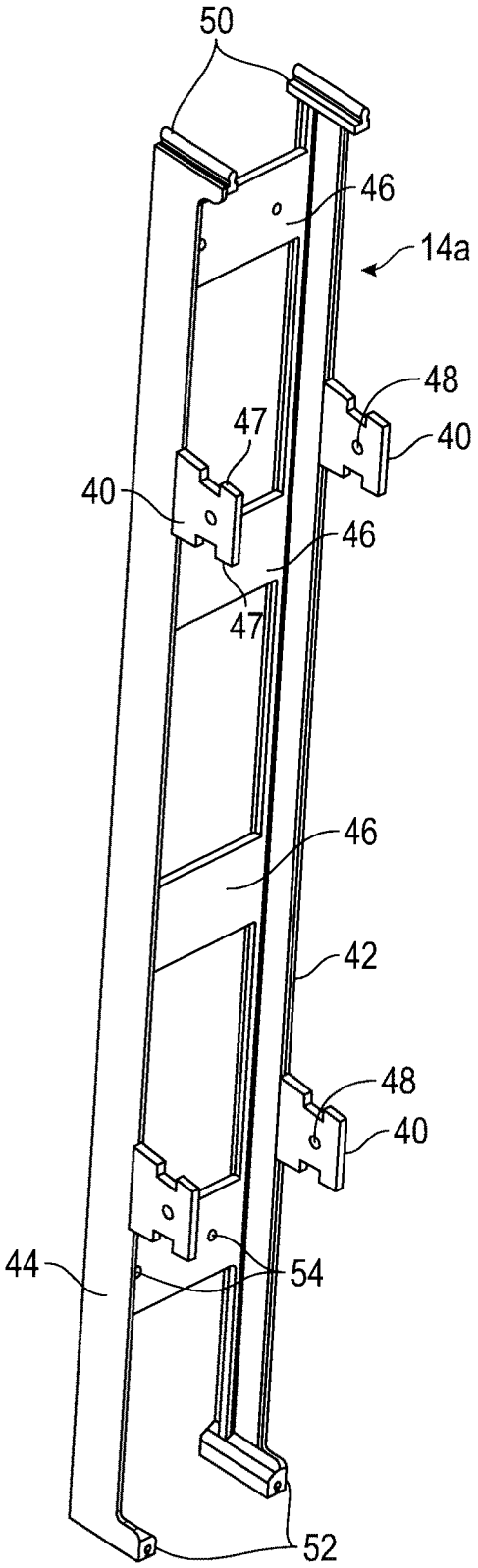
FIG. 5 is a perspective view of a central support beam of the buck panel.

As shown in FIG. 3, the central support beam 14 is positioned longitudinally within the center portion 32 of the foam portion 12. In one embodiment, the central support beam 14 is molded in multiple sections. For example, the central support beam 14 can be molded in two 2-foot long sections 14*a* for insertion into a four foot long buck panel 10. FIG. 5 illustrates one of the central support beam sections 14*a*. Each of the central support beam sections 14*a* may include a first edge 42, a second edge 44, and plates 46 connecting the first edge 42 and second edge 44. The plates 46 extend in a perpendicular relationship relative to the first edge 42 and the second edge 44. The central support beam sections 14*a* have a plurality of wings 40 extending from the first edge 42 and the second edge 44. The wings 40 are configured to protrude a predetermined distance from the internal surface 20 of the foam portion 12 in a way that the wings 40 will be received in the concrete to provide anchor points when the concrete is poured. In one embodiment, the wings 40 are substantially I-shaped. As such, the wings 40 have a pair of opposing protrusions 47 for anchoring to the concrete. It will be appreciated, however, that the wings 40 may be configured in a variety of shapes. In one embodiment, the wings 40 extend from the internal surface 20 of the foam portion 12 in a laterally offset relationship relative to the seats 37*a* and 37*b*.

The central support beam sections 14*a* can be made of any suitable material providing a physical strength and rigidity necessary for the buck panel 10 and for securing attachment devices such as nails and screws for final construction and support of the window or door.

In one embodiment, the wings 40 may each include a hole 48 (FIG. 5). The holes 48 can be used during construction to tie the buck panel 10 to an adjacent block to prevent the buck panel 10 from floating or moving when the concrete is poured. For example, a wire can be threaded through the holes 48 in wing 40 and tied to a web of an adjacent block. Additionally, the holes 48 can be used to secure rebar positioned in rebar holding members 34 in place by stringing a wire through the holes 48 and securing the wire to the rebar.

Figure 7:
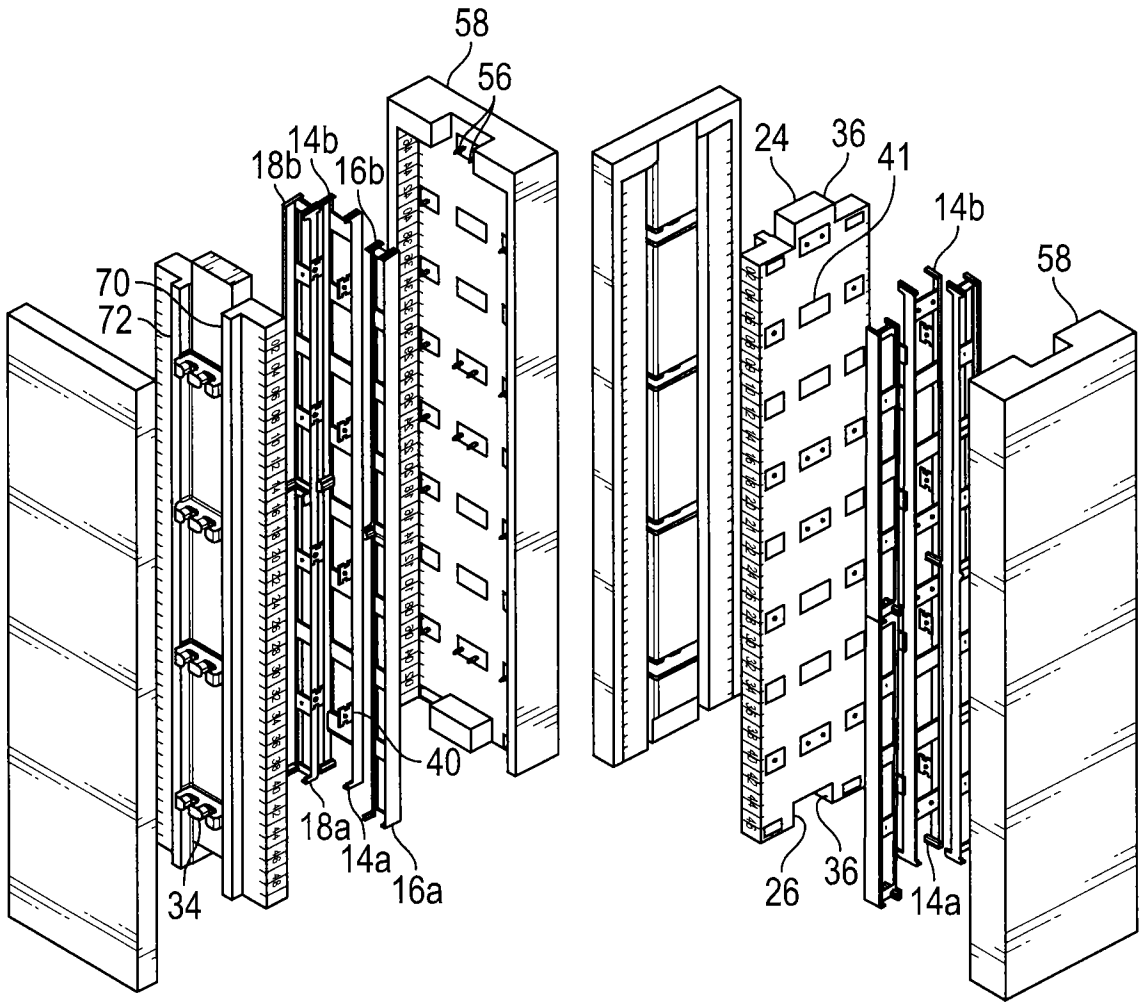
FIG. 7 is front and rear perspective views of an exemplary mold assembly shown in combination with the components of the buck panel of FIG. 1.

In those cases when the central support beam 14 is formed in multiple sections (i.e., 14*a* and 14*b* as shown in FIG. 7), each central support beam section 14*a* may have first ends 50 insertable or otherwise connectable with corresponding second ends 52 of a like central support beam section 14*b*. The use and molding of two shorter connectable central support beam sections can be more economical than molding a single longer central support beam.

Figure 4:
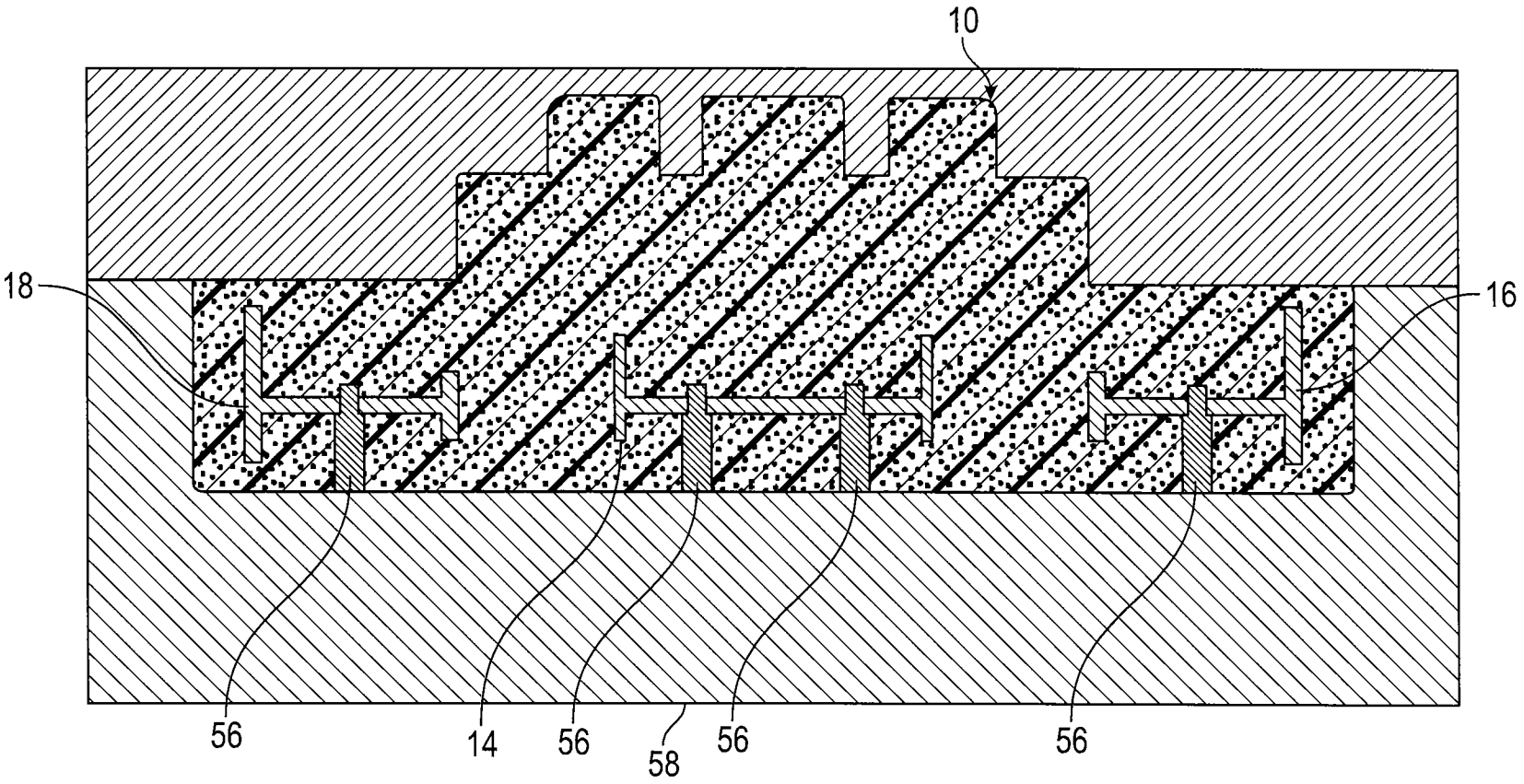
FIG. 4 is a sectional view of the buck panel of FIG. 1 taken along line 4-4 shown in a mold.

At least two of the central support beam 14 plates 46 include one or more pin holes 54. As shown in FIG. 4, when molding the buck panel 10, pins 56 extend a predetermined distance from a mold insert side 58 and through the pin holes 54 to hold the central support beam 14 in place during the molding process.

Figure 6:
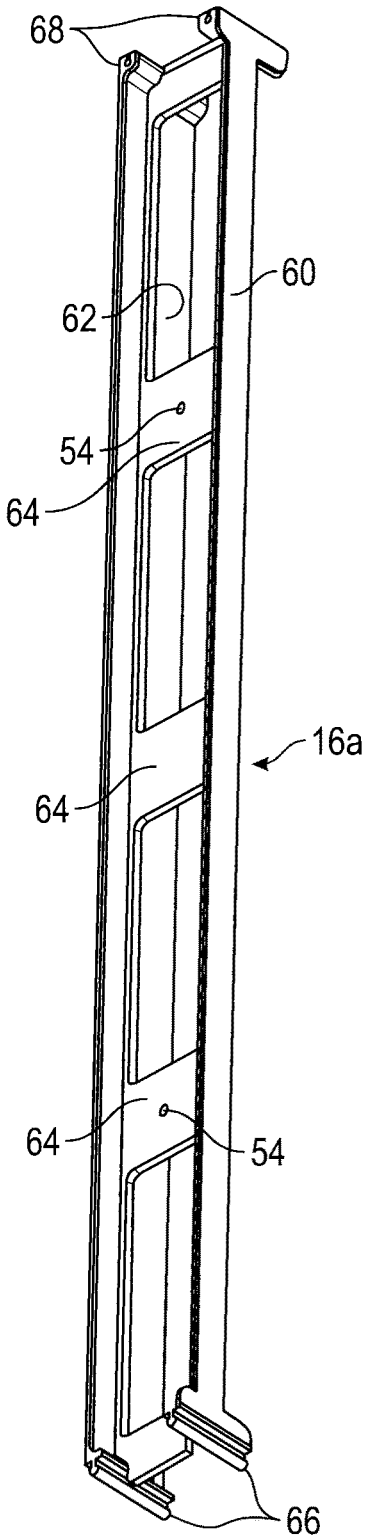
FIG. 6 is a perspective view of a lateral support beam of the buck panel.

First and second lateral support beams 16 and 18, respectively, can be identical and can be made of any suitable material providing a physical strength and rigidity necessary for the buck panel 10 and for securing attachment devices such as nails and screws, for final construction and support of the window or door. As with the central support beam 14, the first and second lateral support beams 16 and 18 can be molded in multiple sections. For example, as shown in FIG. 6, the first lateral support beam 16 can be molded in two 2-foot long sections 16*a* for use in a 4-foot long buck panel 10. In such cases, each lateral support beam section 16*a* includes first ends 66 that can be inserted into or otherwise connected to corresponding second ends 68 of a like lateral support beam section. The first lateral support beam 16 may have a first edge 60 and a second edge 62 connected by a plurality of plates 64.

The markings 41 on the exterior surface 22 of the foam portion 12 for indicating attachment points, more particularly correspond to the position of the plates 46 of the central support beam 14 and the plates 64 of the first and second lateral support beams 16 and 18. Likewise, the markings 45 on the first side 28 and the second side 30 indicate the upper and lower boundaries of the first edge 60 and the second edge 62 of the first and second lateral support beams 16 and 18, respectively.

At least two of the lateral support beam plates 64 include a pin hole 54 to hold the first lateral support beam 16 in place during the molding process. As described above for the central support beam 14 and as shown in FIG. 4, pins 56 extend through the mold insert side 58 of the mold and through the pin holes 54 to hold the first lateral support beam 16 in place during the molding process. The pins 56 can be tapered to help in positioning within the pin holes 54. An exemplary mold assembly for forming the buck panel 10 is shown in FIG. 7.

In one embodiment, the foam portion 12 further comprises a first alignment lip 70 and a second alignment lip 72 proportioned and positioned to fit within a cavity of an insulating concrete block form (not shown) to align and support the buck panel 10 relative to an adjacent concrete form block during the construction process.

From the above description it is clear that the present inventive concept(s) is well adapted to carry out the objects and to attain the advantages mentioned herein as well as those inherent in the inventive concept disclosed herein. While exemplary embodiments of the inventive concept disclosed herein have been described for purposes of this disclosure, it will be understood that numerous changes may be made which will readily suggest themselves to those skilled in the art and which are accomplished without departing from the scope of the inventive concept disclosed herein and defined by the appended claims.

What is claimed is:

1. A buck panel adapted to be interconnected with other panels to form a buck to frame a bulkhead or an opening in a wall for receiving a window or door, the buck panel comprising:

a foam portion having an internal surface, an exterior surface, a first end, a second end opposite the first end, a first side, a second side opposite the first side, and a center portion positioned between the first side and the second side;

a central support beam positioned longitudinally within the center portion of the foam portion, the central support beam having a first edge, a second edge, a plurality of plates extending between and connected to the first edge and the second edge, and a plurality of wings extending from the first edge and the second edge perpendicular to the internal surface of the foam portion in such a way that a portion of the wings protrude from the internal surface of the foam portion so as to be received in concrete poured over the internal surface;

a first lateral support beam positioned longitudinally within the foam portion near the first side of the foam portion and spaced from the central support beam, the first lateral support beam having a first edge, a second edge, and a plurality of plates extending between and connected to the first edge and the second edge; and a second lateral support beam positioned longitudinally within the foam portion near the second side of the foam portion and spaced from the central support beam, the second lateral support beam having a first edge, a second edge, and a plurality of plates extending between and connected to the first edge and the second edge.

2. The buck panel of claim 1, wherein the foam portion further comprises a first alignment lip and a second alignment lip extending outward a predetermined distance from the internal surface, the first alignment lip and the second alignment lip spaced a predetermined distance apart to matingly fit within a cavity of an insulating concrete block form.

3. The buck panel of claim 1, wherein the plurality of wings are substantially I-shaped.

4. The buck panel of claim 1, wherein the wings have a hole through the portion of the wing protruding from the internal surface of the foam portion.

5. The buck panel of claim 1, wherein at least a portion of the internal surface of the foam extends outward a predetermined distance to form a plurality of rebar holding members positioned along the center portion, and wherein the plurality of rebar holding members are provided with a first seat and a second seat defined by predetermined spaces between a first restraining finger, a second restraining finger, and a third restraining finger.

6. The buck panel of claim 5, wherein the predetermined spaces between the first restraining finger, the second restraining finger, and the third restraining finger are sized such that compressibility and resiliency of the foam portion allows the first restraining finger, the second restraining finger, and the third restraining finger to frictionally grip rebar positioned in the first seat and the second seat.

7. The buck panel of claim 5, wherein the plurality of wings are in a laterally offset relationship relative to the first seat and the second seat of the plurality of rebar holding members.

8. The buck panel of claim 1, wherein the exterior surface of the foam portion further comprises a plurality of markings indicative of attachment points.

9. The buck panel of claim 1, wherein the first side of the foam portion further comprises a plurality of markings indicative of upper and lower boundaries of the first edge of the first lateral support beam and the second side of the foam portion further comprises a plurality of markings indicative of upper and lower boundaries of the second edge of the second lateral support beam.

10. The buck panel of claim 1, wherein the first end of the foam portion forms a protruding portion and the second end of the foam portion forms a recessed portion, the protruding portion of the first end of a first buck panel configured to be matingly received in the recessed portion of the second end of a second buck panel.

11. A buck panel adapted to be interconnected with other panels to form a buck to frame a bulkhead or an opening in a wall for receiving a window or door, the buck panel comprising:

a foam portion having an internal surface, an exterior surface, a first end, a second end opposite the first end, a first side, a second side opposite the first side, and a center portion positioned between the first side and the second side, at least a portion of the internal surface extending outward a predetermined distance to form a plurality of rebar holding members positioned along the center portion; and a support beam positioned longitudinally within the foam portion, the support beam having a first edge, a second edge, a plurality of plates extending between and connected to the first edge and the second edge, and a plurality of wings extending from the first edge and the second edge perpendicular to the internal surface of the foam portion in such a way that a portion of the wings protrude from the internal surface of the foam portion so as to be received in concrete poured over the internal surface, wherein the plurality of rebar holding members are provided with a first seat and a second seat defined by predetermined spaces between a first restraining finger, a second restraining finger, and a third restraining finger, and wherein the predetermined spaces between the first restraining finger, the second restraining finger, and the third restraining finger are sized such that compressibility and resiliency of the foam portion allows the first restraining finger, the second restraining finger, and the third restraining finger to frictionally grip rebar positioned in the first seat and the second seat.

12. The buck panel of claim 11, wherein the foam portion further comprises a first alignment lip and a second alignment lip extending outward a predetermined distance from the internal surface, the first alignment lip and the second alignment lip spaced a predetermined distance apart to matingly fit within a cavity of an insulating concrete block form.

13. The buck panel of claim 11, wherein the plurality of wings are substantially I-shaped.

14. The buck panel of claim 11, wherein the wings have a hole through the portion of the wing protruding from the internal surface of the foam portion.

15. The buck panel of claim 11, wherein the plurality of wings are in a laterally offset relationship relative to the first seat and the second seat of the plurality of rebar holding members.

16. The buck panel of claim 11, wherein the exterior surface of the foam portion further comprises a plurality of markings indicative of attachment points.

17. The buck panel of claim 11, wherein the first side of the foam portion further comprises a plurality of markings indicative of upper and lower boundaries of the first edge of the first lateral support beam and the second side of the foam portion further comprises a plurality of markings indicative of upper and lower boundaries of the second edge of the second lateral support beam.

* * * * *